US008690536B2

(12) United States Patent
Beeck et al.

(10) Patent No.: US 8,690,536 B2
(45) Date of Patent: Apr. 8, 2014

(54) TURBINE BLADE TIP WITH VORTEX GENERATORS

(75) Inventors: Alexander R. Beeck, Orlando, FL (US); Glenn E. Brown, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 761 days.

(21) Appl. No.: 12/892,515

(22) Filed: Sep. 28, 2010

(65) Prior Publication Data

US 2012/0076653 A1 Mar. 29, 2012

(51) Int. Cl.
*F01D 5/20* (2006.01)
*F01D 5/08* (2006.01)

(52) U.S. Cl.
USPC ..... 416/90 R; 416/223 A; 416/228

(58) Field of Classification Search
USPC ..... 415/173.1; 416/90 R, 92, 223 A, 228
See application file for complete search history.

(56) References Cited

U.S. PATENT DOCUMENTS 4,682,933 A * 7/1987 Wagner ..... 415/173.5
5,361,828 A * 11/1994 Lee et al. ..... 165/109.1
5,513,982 A * 5/1996 Althaus et al. ..... 431/350
5,518,311 A * 5/1996 Althaus et al. ..... 366/181.5
6,059,530 A * 5/2000 Lee ..... 416/97 R
6,224,337 B1 * 5/2001 Lieland et al. ..... 416/97 R
6,568,909 B2 * 5/2003 Szucs et al. ..... 416/228
6,991,430 B2 * 1/2006 Stec et al. ..... 416/97 R
7,287,959 B2 * 10/2007 Lee et al. ..... 416/97 R
7,510,376 B2 * 3/2009 Lee et al. ..... 416/97 R
7,544,043 B2 * 6/2009 Eastman et al. ..... 416/96 R
2001/0016163 A1 * 8/2001 Tomita et al. ..... 416/193 A
2006/0062671 A1 * 3/2006 Lee et al. ..... 416/92
2013/0129520 A1 * 5/2013 Enevoldsen et al. ..... 416/235

FOREIGN PATENT DOCUMENTS

GB 2427901 A * 1/2007

* cited by examiner

*Primary Examiner* — Edward Look
*Assistant Examiner* — Christopher R Legendre

(57) ABSTRACT

A turbine blade for a turbine engine having a tip with one or more vortex generators for reducing tip leakage during operation of the turbine engine. The vortex generators may extend radially outward from the radially outer surface of the tip wall. The vortex generator may be positioned between a rib extending radially outward from the radially outer surface of the tip wall and an intersection between the outer surface of the tip wall and an outer surface on the pressure side. The vortex generators may include a base and three sides forming a triangular point with a first side having a larger surface are than second and third sides. One or more film cooling holes may be formed in the tip wall to provide cooling air to the tip. In one embodiment, film cooling holes may be positioned in one or more vortex generators.

17 Claims, 2 Drawing Sheets

2/2

TURBINE BLADE TIP WITH VORTEX GENERATORS

FIELD OF THE INVENTION

This invention is directed generally to turbine blades for gas turbine engines, and more particularly to turbine blade tips.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

The hot combustion gases flow from the combustor and past the blades of the rotor assembly. The combustion gases cause the rotor assembly to rotate. Some of the combustion gases flow between the tips of the blades and the outer casing. Such fluids flowing between the tips of the blades and the outer casing result in losses and inefficiencies in the system.

SUMMARY OF THE INVENTION

This invention relates to a turbine blade tip leakage prevention system for turbine blades used in turbine engines to reduce tip leakage during operation of the turbine engines. In particular, the blade tip leakage prevention system may include one or more vortex generators on a tip wall of the turbine blade. The vortex generators may extend radially outward from the tip wall but not a distance sufficient to contact a stationary outer wall during turbine engine operation. In at least one embodiment, the vortex generators may extend a distance from the tip wall generally equal to a rib forming a squealer tip. The vortex generators may be positioned in a number of different positions to limit leakage of gas path gases between the tip of the turbine blade and a stationary outer wall.

The turbine blade may be formed from a generally elongated blade having a leading edge, a trailing edge, a pressure side, a suction side, a tip wall at a first end, wherein the tip wall has a radially outer surface, a root coupled to the blade at an end generally opposite the first end for supporting the blade and for coupling the blade to a disc, and at least one cavity forming a cooling system in the blade. The turbine blade may include one or more ribs extending radially outward from the radially outer surface of the tip wall. The rib may be aligned with an outer surface of the suction side of an outer wall forming the generally elongated blade.

The turbine blade may also include one or more vortex generators positioned at the tip wall. The vortex generator may extend radially outward from the radially outer surface of the tip wall. The vortex generator may be positioned between the rib extending radially outward from the radially outer surface of the tip wall and an intersection between the outer surface of the tip wall and an outer surface on the pressure side. The vortex generator may include a base and three sides forming a triangular point with a first side having a larger surface area than second and third sides. The vortex generator may be formed from a plurality of vortex generators and the plurality of vortex generators may be positioned such that the first side faces into the flow of hot gases, which is generally toward the leading edge. In another embodiment, one or more of the plurality of vortex generators may be positioned such that the first side faces into the flow of hot gases, which is generally toward the leading edge of the generally elongated blade and one or more of the plurality of vortex generators may be positioned such that the first side faces away from the flow of hot gases, which is generally away from the leading edge of the generally elongated blade. In another embodiment, one or more of the plurality of vortex generators are positioned such that the first side faces away from the flow of hot gases, which is generally away from the leading edge.

One or more film cooling holes may be positioned in the tip wall such that the film cooling hole is positioned between the suction side and the pressure side. In another embodiment, the film cooling hole may be positioned on one or more of the three sides of the at least one vortex generator. The film cooling hole may be positioned in a side other than the first side. The tip wall and the vortex generator may be coated with a thermal barrier coating.

In another embodiment, the vortex generator may be formed from a groove cut into the tip wall at an intersection between the tip wall and the pressure side. The groove may be formed from first and second sides.

During turbine engine operation, the turbine blades are attached to a rotor assembly that rotates as hot gases flow past the blades from the combustor. The rib and the vortex generators reduce the leakage of the hot gases past the tip of the blades. In particular, the vortex generators create vortices. The vortices assist in reducing the hot gas leakage at the tip.

An advantage of this invention is that the vortex generators form geometric blockages that reduce leakage in addition to the rib forming the squealer tip.

Another advantage of this invention is that the vortex generators create additional turbulence at the tip in the tip flow, thereby creating additional resistance to air flow passing over the tip.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
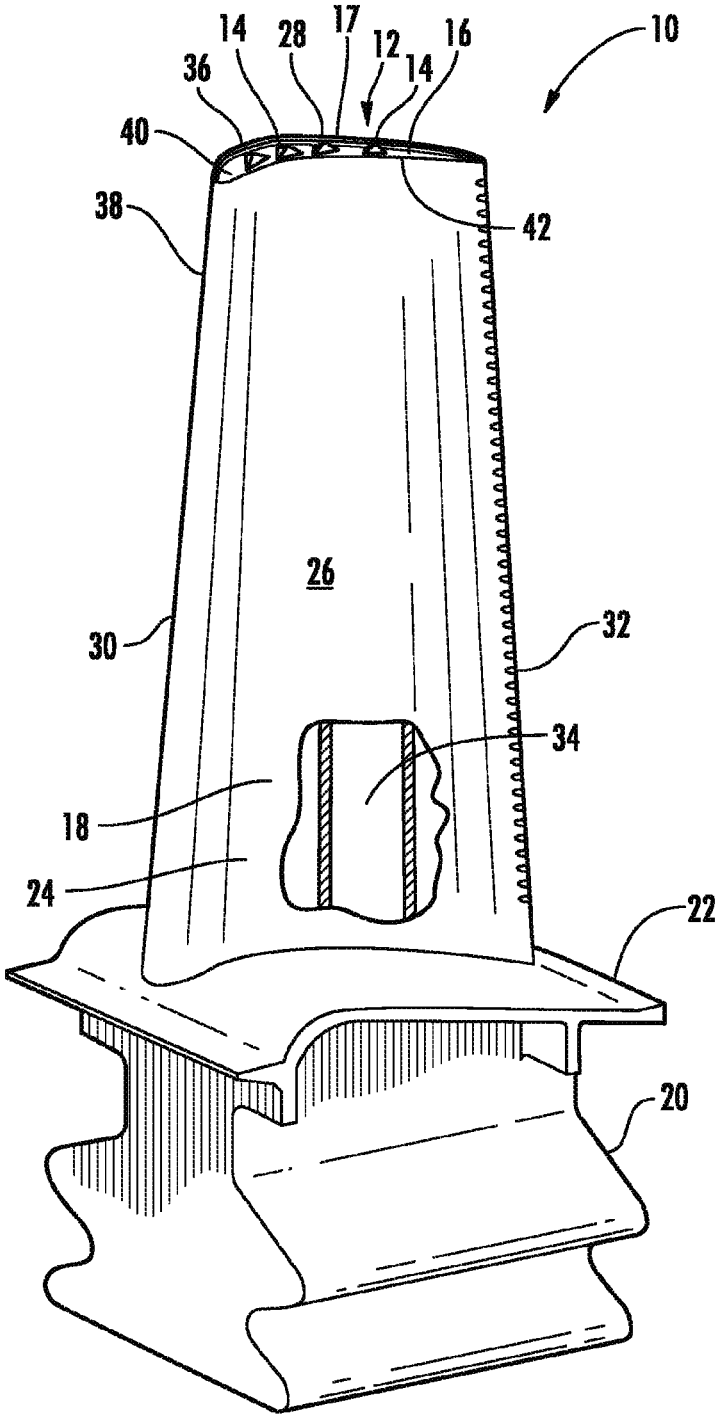
FIG. 1 is a perspective view of a turbine blade having features according to the instant invention.

As shown in FIGS. 1-10, this invention is directed to a turbine blade tip leakage prevention system 10 for turbine blades 12 used in turbine engines to reduce tip leakage during operation of the turbine engines. In particular, the blade tip leakage prevention system 10 may include one or more vortex generators 14 on a tip wall 16 of the turbine blade 12. The vortex generators 14 may extend radially outward from the tip wall 16 but not a distance sufficient to contact a stationary outer wall during turbine engine operation. In at least one embodiment, the vortex generators 14 may extend a distance from the tip wall 16 generally equal to a rib 17 forming a squealer tip. The vortex generators 14 may be positioned in a number of different positions to limit leakage of gas path gases between the tip of the turbine blade 12 and a stationary outer wall.

The turbine blade 12 may be formed from a generally elongated blade 18 coupled to the root 20 at the platform 22. Blade 18 may have an outer wall 24 adapted for use, for example, in a first stage of an axial flow turbine engine. Outer wall 24 may form a generally concave shaped portion forming pressure side 26 and may have a generally convex shaped portion forming suction side 28. The generally elongated blade 18 may have a leading edge 30 and a trailing edge 32. The turbine blade 12 may include an internal cooling system 34 for directing one or more gases, which may include air received from a compressor (not shown), through the blade 18 to reduce the temperature of the blade 18, including film cooling at the tip wall 16. The internal cooling system 34 may be arranged in various configurations and is not limited to a particular flow path.

Figures 2, 3, 4, 5, 6, 7, 8, 9, 10:
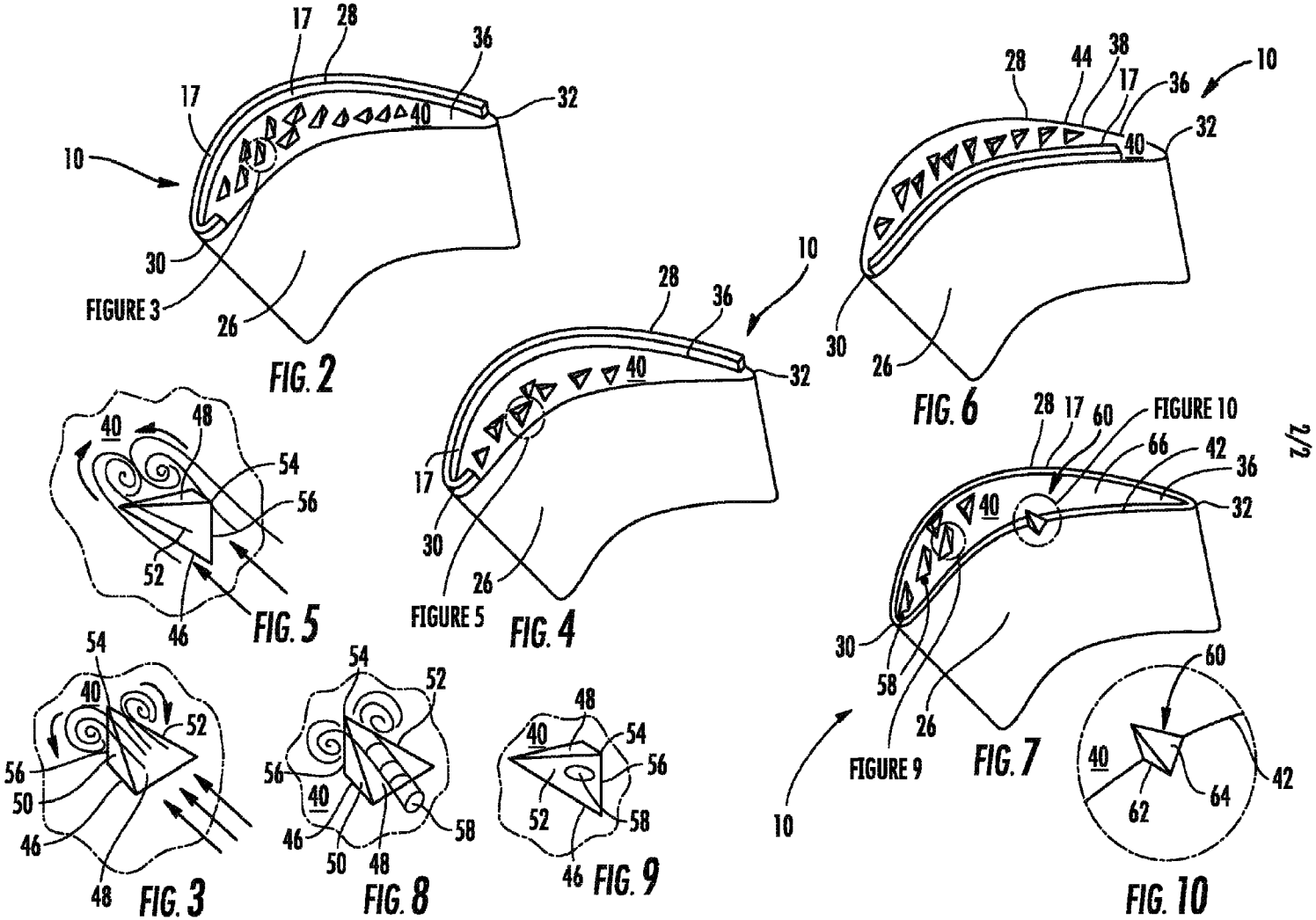
FIG. 2 is detailed perspective view of a tip of the turbine blade shown in FIG. 1 with in flow positioned vortex generators.
FIG. 3 is a detailed perspective view of a vortex generator positioned on the tip of the turbine blade shown in FIG. 2.
FIG. 4 is a detailed perspective view of an alternative embodiment of a tip of the turbine blade shown in FIG. 1 against flow positioned vortex generators.
FIG. 5 is a detailed perspective view of a vortex generator positioned on the tip of the turbine blade shown in FIG. 4.
FIG. 6 is a detailed perspective view of an alternative embodiment of a tip of the turbine blade shown in FIG. 1 with in flow and against flow positioned vortex generators.
FIG. 7 is a detailed perspective view of an alternative embodiment of a tip of the turbine blade shown in FIG. 1 with vortex generators, film cooling holes and groove forming at least one of the vortex generators.
FIG. 8 is a detailed perspective view of a vortex generator positioned on the tip of the turbine blade shown in FIG. 7 with a film cooling hole positioned in the tip wall.
FIG. 9 is a detailed perspective view of a vortex generator positioned on the tip of the turbine blade shown in FIG. 7 with a film cooling hole positioned in a side surface of the vortex generator.
FIG. 10 is a detailed perspective view of a vortex generator formed from a groove cut into the tip wall at an intersection between the tip wall and the pressure side of the turbine blade shown in FIG. 7.

As shown in FIGS. 1, 2, 4, 6 and 7, the turbine blade tip leakage prevention system 10 may have a tip 36 configured to limit the amount of air leakage passing the turbine blade 12 at the tip 36. The tip 36 may have a generally outer surface on the tip wall 16. In at least one embodiment, the turbine blade tip leakage prevention system 10 may include one or more ribs 17 forming a squealer tip. The rib 17 may extend radially outward from the tip wall 16. As shown in FIGS. 1, 2, 4 and 7, the rib 17 may extend radially from the tip wall 16 and be aligned with an outer surface 38 forming the suction side 28. In another embodiment, as shown in FIG. 6, the rib 17 may extend radially from the tip wall 16 and be aligned with an outer surface 38 forming the pressure side 26. The rib 17 may have any appropriate configuration to assist in reducing leakage at the tip 36.

As shown in FIGS. 1, 2, 4, 6 and 7, the vortex generators 14 may extend radially outward from the radially outer surface 40 of the tip wall 16. The vortex generator 14 may be positioned between a rib 17 extending radially outward from the radially outer surface 40 of the tip wall 16 and an intersection 42 between the outer surface 40 of the tip wall 16 and an outer surface 38 on the pressure side 26. In another embodiment, as shown in FIG. 6, the vortex generator 14 may be positioned between a rib 17 extending radially outward from the radially outer surface 40 of the tip wall 16 and an intersection 44 between the outer surface 40 of the tip wall 16 and an outer surface 38 on the suction side 28.

As shown in FIGS. 3, 5, 8 and 9, the vortex generators 14 may include a base 46 and three sides 48, 50, 52 forming a triangular point 54 with a first side 48 having a larger surface than second and third sides 50, 52. The triangular point 54 may be positioned over the base 46 such that an edge 56 between the second and third sides 50, 52 is generally orthogonal to the base 46. In other embodiments, the edge 56 may vary plus or minus 30 degrees from an axis orthogonal to the base 46. As shown in FIG. 2, a plurality of vortex generators 14 may be positioned on the tip wall 16. The vortex generators 14 may be positioned from the leading edge 30 to the trailing edge 32. The vortex generators 14 may all be positioned such that the first side 48 is facing into the flow of hot gases, which is generally toward the leading edge 30 and thus positioned in flow. As shown in FIG. 4, the vortex generators 14 may be positioned at intervals on the tip wall 16, but not for the entirety of the tip wall 16 between the leading edge 30 and the trailing edge 32. Also, all of the vortex generators 14 may be positioned such that the first side 48 is facing away from the flow of hot gases, which is generally away from the leading edge 30 and thus positioned against flow. FIG. 6 shows vortex generators 14 positioned in flow and against flow such that the first side 48 of some vortex generators 14 are facing into the flow of hot gases, which is generally toward the leading edge 30 and some of the vortex generators 14 are facing away from the flow of hot gases, which is generally away from the leading edge 30.

The vortex generators 14 are oriented on the outer surface 40 of the tip wall 16 in concert with the overall flow field create by the airfoil shape and is thus dependent upon the specific airfoil design. Computational fluid dynamics and experimental testing may be used to determine where to position the vortex generators 14. The vortex generators 14 may shed vortices off the sidewalls and downstream surfaces, thus highly mixing and creating turbulence in the local field flow. The turbulence creates aero-dynamic resistance to the tip leakage flow.

The turbine blade tip leakage prevention system 10 may also include film cooling holes 58 in the tip wall 16, as shown in FIGS. 7-9. As shown in FIGS. 7 and 8, the film cooling holes 58 may be positioned in the tip wall 16 in close proximity to the first sides 48 of the vortex generators 14. In another embodiment, as shown in FIG. 9, the film cooling hole 58 may be positioned on a side of the vortex generator 14. In particular, the film cooling hole 58 may be positioned on a side other than the first side, such as a second or third side 50, 52 of the vortex generator 14. Cooling fluids flowing into the internal cooling system 34 may be exhausted through the film cooling holes 58. The film cooling holes 58 cool the vortex generators 14 through convective cooling by bleeding flow from the internal cooling system 34 in the cool, blade core.

In another embodiment, as shown in FIGS. 7 and 10, the vortex generator 14 may be formed from a groove 60 cut into the tip wall 16 at the intersection 42 between the tip wall 16 and the pressure side 26. The groove 60 may be formed from first and second sides 62, 64. The tip wall 16 may include a thermal barrier coating 66 on the outer surface 40, as shown in FIG. 7.

During turbine engine operation, the turbine blades 12 are attached to a rotor assembly that rotates as hot gases flow past the blades 12 from the combustor. The rib 17 and the vortex generators 14 reduce the leakage of the hot gases past the tip 36 of the blades 12. In particular, the vortex generators 14 create vortices, as shown in FIGS. 3 and 5. The vortices assist in reducing the hot gas leakage at the tip 36.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine blade, comprising:

a generally elongated blade having a leading edge, a trailing edge, a pressure side, a suction side, a tip wall at a first end, wherein the tip wall has a radially outer surface, a root coupled to the blade at an end generally opposite the first end for supporting the blade and for coupling the blade to a disc, and at least one cavity forming a cooling system in the blade;

at least one vortex generator positioned at the tip wall;

wherein the at least one vortex generator extends radially outward from the radially outer surface of the tip wall;

wherein the at least one vortex generator includes a base and three sides forming a triangular point with a first side having a larger surface area than second and third sides.

2. The turbine blade of claim 1, further comprising at least one rib extending radially outward from the radially outer surface of the tip wall.

3. The turbine blade of claim 2, wherein the at least one rib is aligned with an outer surface of the suction side of an outer wall forming the generally elongated blade.

4. The turbine blade of claim 3, wherein the at least one vortex generator is positioned between the at least one rib extending radially outward from the radially outer surface of the tip wall and an intersection between the outer surface of the tip wall and an outer surface on the pressure side.

5. The turbine blade of claim 1, further comprising at least one film cooling hole in the tip wall, wherein the at least one film cooling hole is positioned on one or more of the three sides of the at least one vortex generator.

6. The turbine blade of claim 5, wherein the at least one film cooling hole is positioned in a side other than the first side.

7. The turbine blade of claim 1, wherein the tip wall and the at least one vortex generator is coated with a thermal barrier coating.

8. The turbine blade of claim 7, wherein the at least one vortex generator is formed from a plurality of vortex generators and wherein at least one of the plurality of vortex generators is positioned such that the first side faces into the flow of hot gases, which is generally toward the leading edge.

9. The turbine blade of claim 8, wherein at least one of the plurality of vortex generators is positioned such that the first side faces away from the flow of hot gases, which is generally away from the leading edge.

10. The turbine blade of claim 7, wherein the at least one vortex generator is formed from a plurality of vortex generators, and wherein at least one of the plurality of vortex generators is positioned such that the first side faces away from the flow of hot gases, which is generally away from the leading edge.

11. The turbine blade of claim 1, further comprising at least one film cooling hole in the tip wall, wherein the at least one film cooling hole is positioned between the suction side and the pressure side.

12. The turbine blade of claim 1, wherein the at least one vortex generator is formed from a groove cut into the tip wall at an intersection between the tip wall and the pressure side.

13. The turbine blade of claim 12, wherein the at least one groove is formed from first and second sides.

14. A turbine blade, comprising:

a generally elongated blade having a leading edge, a trailing edge, a pressure side, a suction side, a tip wall at a first end, wherein the tip wall has a radially outer surface, a root coupled to the blade at an end generally opposite the first end for supporting the blade and for coupling the blade to a disc, and at least one cavity forming a cooling system in the blade;

at least one rib extending radially outward from the radially outer surface of the tip wall, wherein the at least one rib is aligned with an outer surface of the suction side of an outer wall forming the generally elongated blade;

a plurality of vortex generators extending radially outward from the radially outer surface of the tip wall;

wherein the plurality vortex generators are positioned between the at least one rib extending radially outward from the radially outer surface of the tip wall and an intersection between the outer surface of the tip wall and an outer surface on the pressure side;

wherein at least one of the vortex generators includes a base and three sides forming a triangular point with a first side having a larger surface area than second and third sides.

15. The turbine blade of claim 14, further comprising at least one film cooling hole in the tip wall, wherein the at least one film cooling hole is positioned on one or more of the three sides of the plurality of vortex generators.

16. The turbine blade of claim 14, further comprising at least one film cooling hole in the tip wall, wherein the at least one film cooling hole is positioned between the suction side and the pressure side.

17. A turbine blade, comprising:

a generally elongated blade having a leading edge, a trailing edge, a pressure side, a suction side, a tip wall at a first end, wherein the tip wall has a radially outer surface, a root coupled to the blade at an end generally opposite the first end for supporting the blade and for coupling the blade to a disc, and at least one cavity forming a cooling system in the blade;

at least one rib extending radially outward from the radially outer surface of the tip wall, wherein the at least one rib is aligned with an outer surface of the suction side of an outer wall forming the generally elongated blade;

a plurality of vortex generators extending radially outward from the radially outer surface of the tip wall;

wherein the plurality of vortex generators are positioned between the at least one rib extending radially outward from the radially outer surface of the tip wall and an intersection between the outer surface of the tip wall and an outer surface on the pressure side; and at least one vortex generator formed from a groove cut into the tip wall at an intersection between the tip wall and the pressure side, wherein the at least one groove is formed from first and second sides.

* * * * *